United States Patent [19]

Thurman

[11] 4,023,680

[45] May 17, 1977

[54] BAKERY TRAY

[75] Inventor: Paul G. Thurman, West Liberty, Ohio

[73] Assignee: Dare Plastics Inc., Urbana, Ohio

[22] Filed: Sept. 22, 1971

[21] Appl. No.: 182,728

[52] U.S. Cl. ..... 206/507

[51] Int. Cl.[2] ..... B65D 21/04

[58] Field of Search ..... 220/66, 97 D; 211/126; 206/505, 507

[56] References Cited

UNITED STATES PATENTS

| | | | |
|---|---|---|---|
| 3,055,531 | 9/1962 | De Chelbor | 220/21 |
| 3,155,268 | 11/1964 | Fogerty | 220/21 |
| 3,353,703 | 11/1967 | Bartoo | 220/21 |
| 3,362,576 | 1/1968 | Beesley | 220/72 |
| 3,392,875 | 7/1968 | Bockenst et al. | 220/66 |
| 3,443,717 | 5/1969 | Wettlen | 220/66 |
| 3,494,502 | 2/1970 | Roush | 220/66 |
| 3,613,943 | 10/1971 | Bridenstine | 220/97 D |
| 3,675,815 | 7/1972 | Rehrig | 211/126 |
| D195,101 | 4/1963 | Fogerty | 220/DIG. 15 |

*Primary Examiner*—George E. Lowrance
*Attorney, Agent, or Firm*—Wood, Herron & Evans

[57] ABSTRACT

A unitary molded plastic tray which is stackable for purposes of transporting bakery goods and the like therein and which is nestable for purposes of empty tray storage. The tray has two opposed high profile end walls and two low profile side walls as well as a bottom made from a grid of intersecting ribs. The tray is so configurated that like trays may be stacked one upon the other when similarly oriented and may be nested one within the other when one tray is rotated 90° with respect to the other. The gridwork of bottom ribs are generally T-shaped in cross sectional configuration and extend diagonally across the bottom at an angle of approximately 45° to the side and end walls so that the bottom structure resists torsional deflection under uneven loading conditions as well as vertical deflection from excessively heavy loads.

6 Claims, 9 Drawing Figures

INVENTOR.
Paul S. Thurman
BY
Wood, Herron and Evans
ATTORNEYS

INVENTOR.
Paul S. Thurman
BY
Wood, Herron & Evans
ATTORNEYS

BAKERY TRAY

BACKGROUND OF THE INVENTION

This invention relates to the field of trays for storing and transporting bakery goods and the like and particularly to the field of such trays which may be nested one within the other for storing in an empty condition but may be stacked one upon another when the trays are full of bakery goods.

There are in the prior art innumerable unitary plastic trays which are both nestable and stackable. Additionally, there are numerous such trays which may be stacked one upon the other when the trays are similarly oriented and which may be nested one within the other when the trays are rotated 90°. One such tray of this latter type is illustrated in Bockenstette U.S. Pat. No. 3,392,875.

All of the molded plastic trays which have open gridwork bottom walls made from a gridwork of intersecting ribs tend to bow in the center when loaded heavily because of the lack of rigidity of the rib-defining gridwork. Additionally, trays of the type shown in the Bockenstette patent which have long low profile side walls and relatively shorter high profile end walls lack sufficient rigidity to resist torsional flexure if the tray is unevenly loaded.

Accordingly, it has been a primary objective of this invention to provide a unitary molded plastic tray which has a long low profile side wall and high profile end walls as well as an open gridwork bottom structure but which has a very rigid bottom which better resists bowing and torsional deflection than prior art trays.

This objective is accomplished and this invention is predicated upon the discovery that a unitary molded plastic tray which has an open gridwork bottom structure defined by intersecting ribs and which has a pair of high profile end walls and low profile side walls may be made much more rigid than prior art trays if the ribs which form the bottom gridwork are generally T-shaped in cross section and extend diagonally across the side and end walls so that the ribs form an acute angle of approximately 45° with the side and end walls. This structure results in a tray in which the bottom better resists bowing under heavily loaded conditions as well as torsional flexing when the tray is unevenly loaded or is twisted between handles in the end walls.

The primary advantage of the tray of this invention is that it provides a more rigid structure without requiring any greater quantity of material and without requiring that the tray be made from different material than prior art trays.

These and other objects and advantages of this invention will be more readily apparent from the following description of the drawings in which.

DESCRIPTION OF THE PREFERRED EMBODIMENT

Referring first to FIGS. 1, 2, 8, and 9, there is illustrated a preferred embodiment of a bakery tray incorporating the invention of this application. While the tray is referred to as a bakery tray, it, of course, may be utilized for transporting items other than bakery goods. However, this particular tray incorporated features which render it particularly suitable for this application.

The tray 10 comprises a bottom wall 11, opposed end walls 12, 12′, and a pair of opposed side walls 13, 13′. The top of the tray is open.

The tray 10 is rectangular and has end walls 12 which are substantially shorter than the side walls 13. The end walls are also of much greater height than the side walls. These relative length and height relationships are necessary for stacking and nesting purposes as will be described more fully hereinafter.

Figure 2:
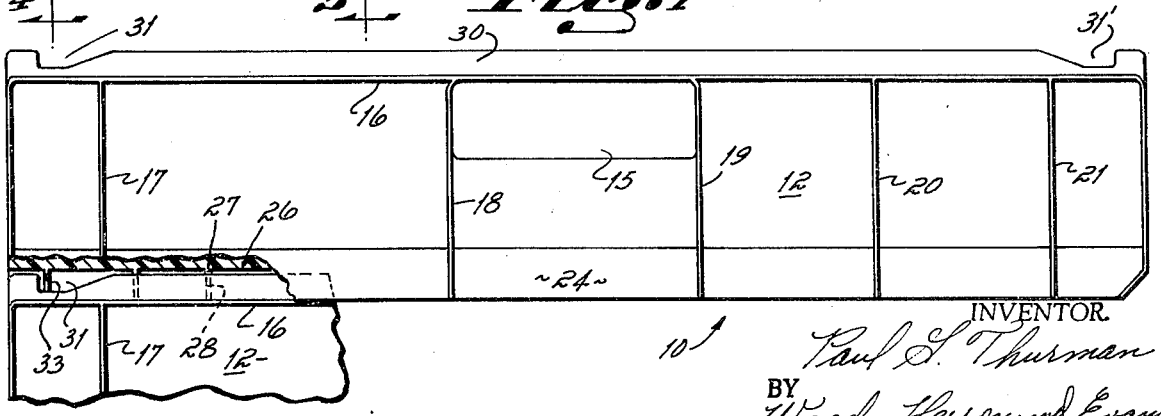
FIG. 2 is an end elevational view, partially broken away, of the tray of FIG. 1 illustrating the mode of stacking of the trays.
Figure 9:
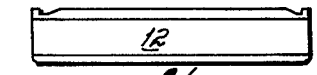
FIG. 9 is an end elevational view of the tray of FIG. 1 drawn to the same scale as FIG. 8.

As may be seen most clearly in FIGS. 2 and 9, the end walls (which are mirror images of each other) are solid or full walls which have only a single opening 15 therein. This opening 15 is a hand-hold opening which is located midway along the length of the end wall and adjacent the top. On the outside of each wall and adjacent the top, there is a horizontal ledge 16 which extends for the length of the end wall. Additionally, there are five vertical reinforcing ribs 17–21 which extend from the ledge 16 downwardly to the bottom of the tray.

Along the bottom, each of the end walls 12, 12′, flare outwardly to form a lower outwardly extending lip 24 which is located beneath the bottom wall 11. A pair of flanges 25 extends downwardly from the bottom wall 11 of the tray near each of the lips 24. These bottom flanges 25 extend parallel to the lips 24 and cooperate with the lips 24 to form a pair of recesses or grooves 26 in the bottom of the tray beneath the end walls 12, 12′. To prevent spreading or deflection of the lip 24 and flange 25, a plurality of ribs 27 extends between them. The ribs each have a V-shaped recess 28 along the lower edge. These recesses 28 receive the upper portion or topmost ridge 30 of the side walls 12, 12′ when two like trays are stacked one upon the other.

A pair of recesses 31, 31′ are located in the top surface of each of the ridges 30 adjacent the ends. When the trays are stacked, these notches each receive a rib 33, 33′ in one of the bottom grooves 26 so that the stacked trays cannot slide transversely relative to one another.

The side walls 13, 13′ extend for the full length of the tray from one end 12 to the other end 12′. As may be seen most clearly in FIG. 8, the side walls 13, 13′ are identical and except at the outer ends are approximately one-half the height of the end walls 12, 12′. There is a vertical flange 37 at the end of each side wall which extends from the top of the side wall 13, 13′ to a height approximately the same as that of the end wall. The inside edge 38 of each flange 37 is tapered downwardly and inwardly so that it acts as a guide when one tray is nested within another. The low profile side walls 13 enable one tray to be nested within another like tray with the bottom surface of the side wall of one tray resting upon the top surface 39 of the side wall 13 of another tray when that one tray is rotated 90° relative to the like tray. A third tray rotated 90° to the second may then be stacked on the first tray without any interference from the second nested tray.

Figure 3:
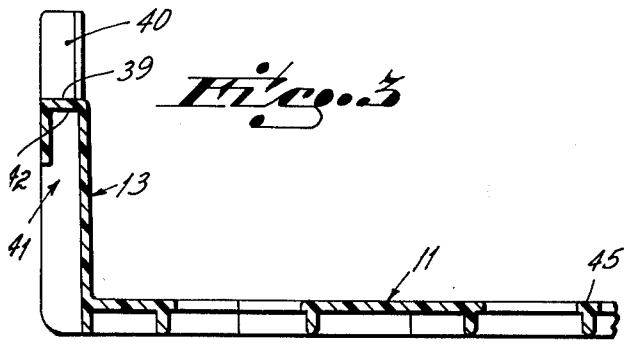
FIG. 3 is a cross sectional view through the tray taken on line 3—3 of FIG. 1.
Figure 7:
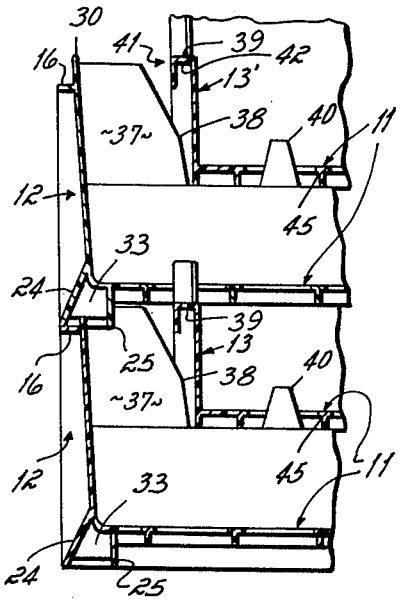
FIG. 7 is a cross sectional view through the nested trays taken on line 7—7 of FIG. 6.
Figure 8:
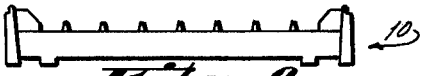
FIG. 8 is a side elevational view of the tray of FIG. 1.

As may be seen most clearly in FIGS. 3 and 7, the side walls 13, 13' of the tray 10 terminate at their upper ends in an outwardly and downwardly turned flange 41. The outwardly or horizontally extending portion 42 of the flange 41 defines the top surface 39 of the side walls 13, 13'.

Equidistantly spaced along the top surfaces 39 of the side walls 13, there are a plurality of vertical posts 40. These posts act as a "fence" to preclude articles from sliding out of the tray. The particular tray illustrated in the drawings is a so-called "bun tray" because it is primarily utilized to transport packaged buns. These buns are usually stacked two layers high, with the result that the upper layer may slide out of the open sides of the tray in the absence of the posts 40. The spacing of the posts is such that they may fit into openings in the open gridwork bottom of the tray when the trays are nested, as illustrated in FIG. 7. The posts are preferably tapered so that they tend to act as guides when one tray is nested within another.

Figure 4:
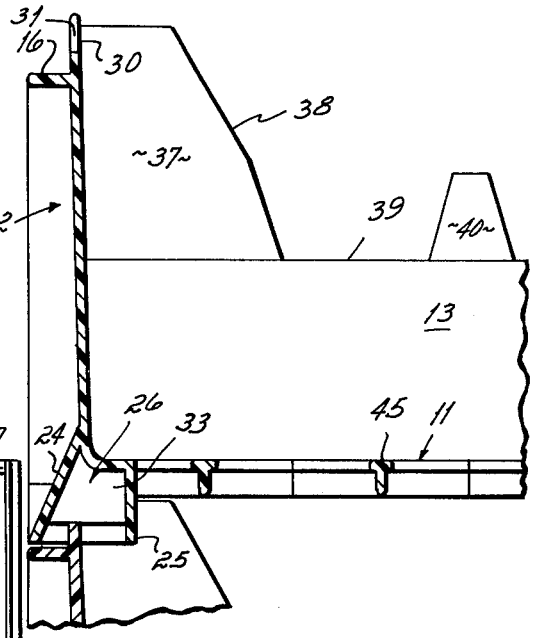
FIG. 4 is a cross sectional view of the tray taken on line 4—4 of FIG. 2.
Figure 6:
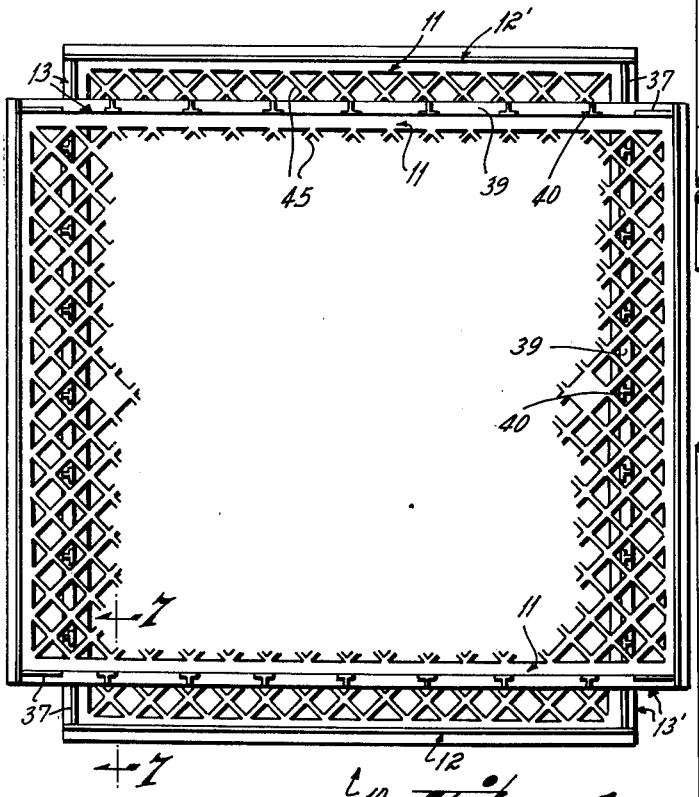
FIG. 6 is a top plan view of a pair of like nested trays.
Figure 5:
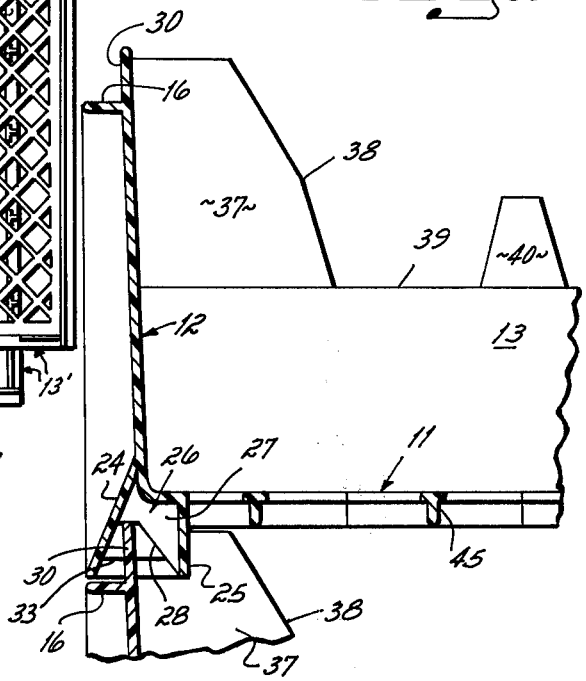
FIG. 5 is a cross sectional view of the tray taken on line 5—5 of FIG. 2.

Conventionally, bakery goods trays are made with a perforated bottom so that moisture cannot collect in the bottom. The tray 10 has a perforated bottom in which the perforations or openings are defined by a gridwork of ribs 45. As may be seen most clearly in FIGS. 4 and 5, the ribs of this gridwork are generally T-shaped in configuration with the cross bar of the T forming the bottom inside surface of the tray. The vertical portion of the T is approximately the same thickness as the cross bar portion and acts as a reinforcement to rigidify the bottom.

The ribs 45 extend diametrically between the sides and ends of the tray so that they form an angle of approximately 45° with the side and end walls. This orientation of the ribs has been found to be far superior in tray rigidity as compared to having the ribs extend parallel to the side and end walls. Specifically, this orientation of the ribs has been found to greatly strengthen the tray against torsional flexure and against bowing of the bottom. Torsional flexure occurs when the tray is unevenly loaded or when the two handles are twisted in opposite directions. Bowing occurs when excessive loads are placed in the tray.

Figure 1:
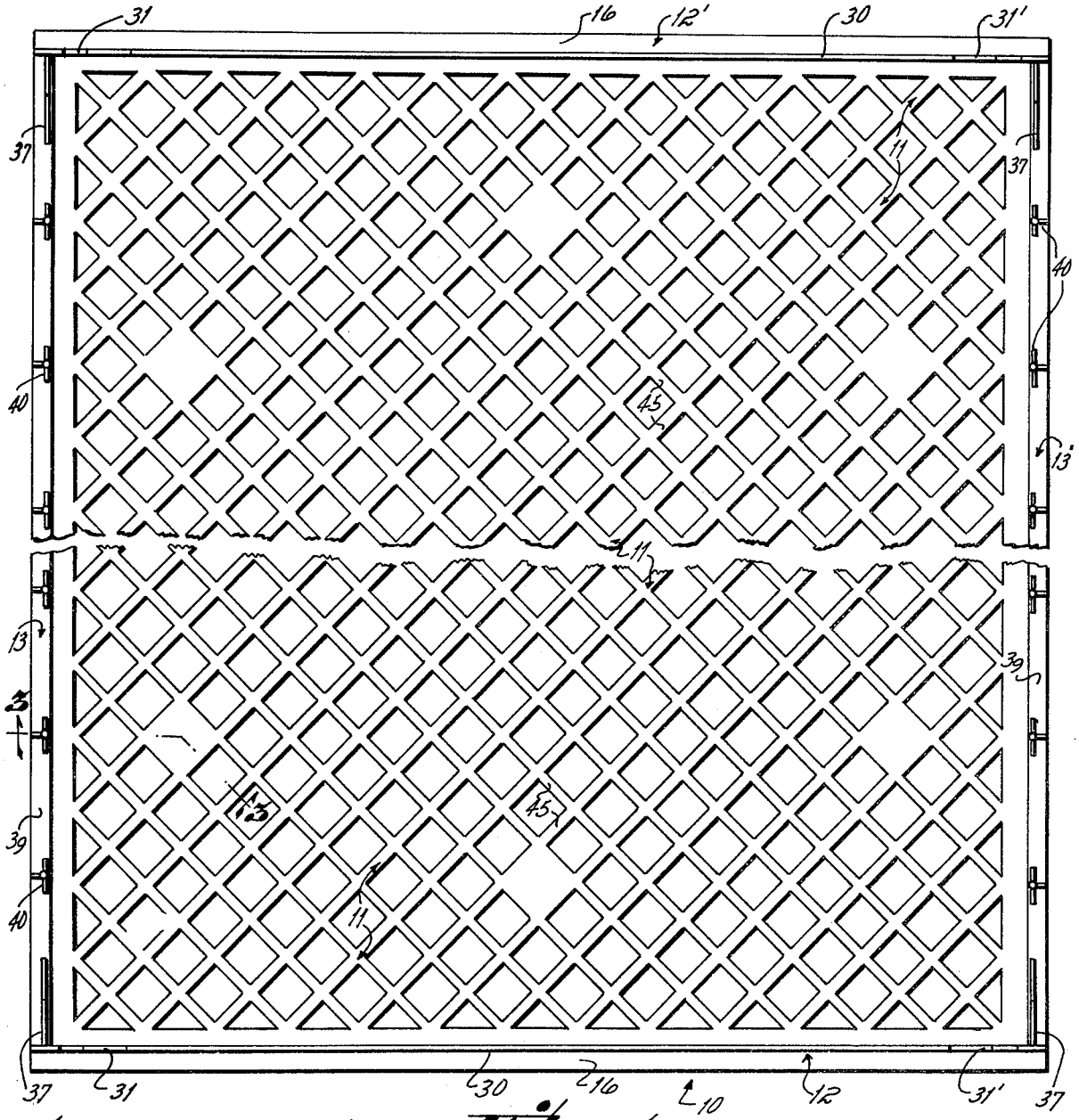
FIG. 1 is a top plan view of a tray incorporating the invention of this application.

As may be seen most clearly in FIG. 1, the bottom of the tray has several solid pads which fill the apertures at spaced locations throughout the bottom of the tray. These pads are located at the mold sprue hole sites or the sites at which excess liquid material is located during the formation of the tray. Rather than to cut the aperture from the solid pad, the practice is to leave the pad in the bottom of the tray. Often the pad is used as a marking site for customer identification. The pads also serve in the preferred embodiment to prevent incorrect nesting of the trays by preventing the posts 40 from being inserted into the wrong row of apertures in the bottom.

The tray heretofore described has the advantage of being easily molded as a unitary plastic item from a minimum of material. It has the advantage over similar prior art trays which nest and stack in exactly the same manner of having a more rigid bottom than has heretofore been available. The rigidity of this bottom is such that it resists bowing of the bottom when the tray is heavily loaded as well as torsional loading of the tray when it is unevenly loaded.

While I have described only a single preferred embodiment of my invention, persons skilled in this art will appreciate modifications and changes which may be made without departing from the spirit of my invention. Therefore, I do not intend to be limited except by the scope of the appended claims.

Having described my invention, I claim:

1. A unitary molded plastic nesting and stacking tray for storing and transporting bakery goods and the like, said tray being rectangular when viewed in a top plan view and having a bottom wall, a pair of opposed end walls, and a pair of opposed side walls, said end walls being substantially shorter in length than said side walls and said side walls being substantially shorter in height than said end walls whereby a like tray in like orientation may be stacked thereon and when oriented at 90° with respect to a like tray may be nested therein, said end walls because of their greater height and shorter length having substantially greater resistance to torsional flexure of the tray than said side walls, the improvement wherein said bottom wall consists of a plurality of crossing ribs defining rows of openings therebetween, said bottom ribs being T-shaped in cross section and extending diagonally across the bottom of said tray at an acute angle to the side and end walls.

2. The tray of claim 1 in which the cross bars of the T-shaped ribs form the bottom inside surface of the tray.

3. The tray of claim 1 in which said ribs extend across the bottom of said tray at an angle of approximately 45° with said side and end walls.

4. A unitary molded plastic nesting and stacking tray for storing and transporting bakery goods and the like, said tray being rectangular when viewed in a top plan view and having a bottom wall, a pair of opposed end walls, and a pair of opposed side walls, each of said end walls having a ridge extending across the top from one side wall to the other and a downwardly opening recess extending across the bottom from one side wall to the other, said end walls being substantially shorter in length than said side walls and said side walls being substantially shorter in height than said end walls whereby a like tray in like orientation may be stacked thereon and when oriented at 90° with respect to a like tray may be nested therein, said trays when stacked having end wall ridges of one tray received in end wall recesses of a like tray, said end walls because of their greater height and shorter length having substantially greater resistance to torsional flexure of the tray than said side walls, the improvement wherein said bottom wall consists of a plurality of crossing ribs defining rows of openings therebetween, said bottom ribs being T-shaped in cross section and extending diagonally across the bottom of said tray at an acute angle to the side and end walls.

5. The tray of claim 1 in which the cross bars of the T-shaped ribs form the bottom inside surface of the tray.

6. The tray of claim 1 in which said ribs extend across the bottom of said tray at an angle of approximately 45° with said side and end walls.

* * * * *